United States Patent [19]

Thomas et al.

[11] Patent Number: 4,537,643

[45] Date of Patent: Aug. 27, 1985

[54] METHOD FOR THERMOMECHANICALLY ROLLING HOT STRIP PRODUCT TO A CONTROLLED MICROSTRUCTURE

[75] Inventors: John E. Thomas, Pittsburgh; Ronald D. Gretz, Tarentum; George W. Tippins, Pittsburgh, all of Pa.

[73] Assignee: Tippins Machinery Company, Inc., Pittsburgh, Pa.

[21] Appl. No.: 629,579

[22] Filed: Jul. 11, 1984

Related U.S. Application Data

[62] Division of Ser. No. 397,789, Jul. 13, 1982, Pat. No. 4,505,141.

[51] Int. Cl.[3] ..... C21D 7/14

[52] U.S. Cl. ..... 148/12 R; 148/155

[58] Field of Search ..... 148/12 R, 155

[56] References Cited

U.S. PATENT DOCUMENTS

| | | | |
|---|---|---|---|
| 4,021,272 | 5/1977 | Asai et al. | 148/155 |
| 4,046,598 | 9/1977 | Janzon | 148/12 R |
| 4,466,842 | 8/1984 | Yada et al. | 148/12 R |

FOREIGN PATENT DOCUMENTS

| | | | |
|---|---|---|---|
| 2455794 | 6/1976 | Fed. Rep. of Germany | 148/12 R |
| 197802 | 2/1978 | U.S.S.R. | 148/12 R |

*Primary Examiner*—Veronica O'Keefe

*Attorney, Agent, or Firm*—Webb, Burden, Robinson & Webb

[57] ABSTRACT

A hot strip mill having a final reducing stand and runout cooling means downstream of the reducing stand includes an incubator capable of coiling and decoiling the hot strip. The incubator is located intermediate the runout cooling means. In a preferred form the final reducing stand is a hot reversing mill. A second incubator and/or a temper mill and/or a slitter may be positioned downstream of the first incubator. The method of rolling includes isothermally treating the strip within a predetermined time and temperature range in the incubator prior to subsequent processing. The subsequent processing may include any one or more of the following: further deformation by cold rolling, temper rolling or cooling at a desired heat loss rate.

10 Claims, 9 Drawing Figures

METHOD FOR THERMOMECHANICALLY ROLLING HOT STRIP PRODUCT TO A CONTROLLED MICROSTRUCTURE

This application is a division, of application Ser. No. 397,789, filed July 13, 1982, now U.S. Pat. No. 4,505,141.

FIELD OF THE INVENTION

Our invention relates generally to hot strip rolling methods and apparatus and more particularly to methods and apparatus for thermomechanically hot rolling strip steels or plates of various compositions to a controlled microstructure on a mill, which mill includes incubation means located intermediate the cooling means on the runout table associated with the hot strip or plate mill.

DESCRIPTION OF THE PRIOR ART

The metallurgical aspects of hot rolling steels have been well known for many years, particularly in respect of the standard carbon and low alloy grades. The last reduction on the final finishing stand is normally conducted above the upper critical temperature on virtually all hot mill products. This permits the product to pass through a phase transformation after all hot work is finished and produces a uniformly fine equiaxed ferritic grain throughout the product. This finishing temperature is on the order of 1550° F. (843° C.) and higher for low carbon steels.

If the finishing temperature is lower and hot rolling is conducted on steel which is already partially transformed to ferrite, the deformed ferrite grains usually recrystallize and form patches of abnormally coarse grains during the self-anneal induced by coiling or piling at the usual temperatures of 1200°-1350° F. (649°-732° C.).

For these low carbon steels the runout table following the last rolling stand is sufficiently long and equipped with enough quenching sprays to cool the product some 200°-500° F. (93°-260° C.) below the finishing temperature before the product is finally coiled or hot sheared where the self-annealing effect of a large mass takes place.

It is further recognized that some five phenomena take place that collectively control the mechanical properties of the hot rolled carbon steel product. These five phenomena are the precipitation of the MnS or AlN or other additives in austenite during or subsequent to rolling but while the steel is in the austenite temperature range, recovery and recrystallization of the steel subsequent to deformation, phase transformation to the decomposition products of ferrite and carbide, carbide coarsening and interstitial precipitation of the carbon and/or nitrogen on cooling to a low temperature.

After hot rolling the product is often reprocessed such as by normalizing, annealing or other heat treatment to achieve the metallurgical properties associated with a given microstructure as well as relieve or redistribute stress. Such a hot rolled product may also be temper rolled to achieve a desired flatness or surface condition. In addition, mill products processed after hot rolling such as cold rolled steel and tin plate are to a degree controlld by the metallurgy (microstructure) of the hot rolled band from which the other products are produced. For example the hot band grain size is a factor in establishing the final grain size even after deformation and recrystallization from tandem reducing and annealing respectively.

Heretofore, the semi-continuous hot strip mills as well as the so-called mini-mills which utilize hot reversing stands provide continuous runout cooling by means of water sprays positioned above and/or below the runout table extending from the last rolling stand of the hot strip mill to the downcoilers where the material is coiled or to the hot shears where a sheet product is produced. This runout table cooling is the means by which the hot band is cooled so as to minimize grain growth, carbide coarsening or other metallurgical phenomena which occur when the hot band is coiled or sheared and stacked in sheets and self-annealing occurs due to the substantial mass of the product produced.

The various heat treatments and temper rollings which are utilized to achieve desired properties and shape occur subsequent to the hot mill processing per se. For example, where a certain heat treatment is called for, the coiled or stacked sheet product is placed in the appropriate heat treating facility, heated to the desired temperature and thereafter held to accomplish the desired microstructure or stress relief.

In-line heat treatment has been employed with bar and rod stock. However, the surface to volume ratio of such a product vis-a-vis a hot band presents different types of problems and the objective with rod and bar stock is generally to obtain differential properties as opposed to the uniformity required of most hot strip products. Finally, in today's market, processing flexibility and the desired microstructure are more important than the sheer productivity capability of the mill. Existing hop strip facilities are primarily geared for productivity and therefore are not compatible with today's market demands.

SUMMARY OF THE INVENTION

Our invention recognizes the demands of today's market and provides flexibility and quality within the hot strip mill itself. At the same time it aids the productivity of the overall steel making operation by eliminating certain subsequent processing steps and units and consolidating them into the hot rolling process. We are able to operate within narrow target time and temperature ranges. In so doing we are able to provide a hot strip product with a controlled and reproducible microstructure.

Our invention further provides a new product development tool because of its ease of operation and substantial flexibility.

The phase transformations encountered in the rolling and treating of steels are known and are shown by the available phase diagrams and the kinetics are predictable from the appropriate TTT diagrams and thus a desired microstructure can be obtained. In addition, recovery and recrystalization kinetics are known for many materials. Heretofore hot mills were drastically limited in that regard because of the inflexibility of the tail end of the hot rolling process.

This flexibility is made possible by providing an incubator capable of coiling and decoiling the hot strip and locating that incubator intermediate the runout cooling means so as to define a first cooling means upstream of the incubator and a second cooling means downstream of the incubator. A second or additional incubator(s) may be used in-line. The incubator may include heating means or atmosphere input means to give further flexibility to the hot rolling process. In addition, a temper mill and/or a slitter may be positioned in-line at a point where the strip is sufficiently cooled to permit proper processing.

The method of rolling generally includes causing the strip to leave the final reducing stand at a temperature above the upper critical $A_3$, cooling the strip to a temperature below the $A_3$ by first cooling means, coiling the strip in the incubator to maintain temperature and cause nucleation and growth of the ferrite particles in the austenite, thereafter decoiling the strip out of the incubator and cooling it rapidly to minimize grain growth and carbide coarsening. Where the temper mill is employed the strip may then be temper rolled after being cooled to the appropriate temperature. By maintaining temperature it is meant that we seek to approach an isothermal condition, although in practice there is a temperature decay with time which we seek to minimize.

A further means of processing hot strip includes utilizing a hot reversing mill as the final mill and reducing the band through the penultimate pass at a temperature above the $A_3$ and thereafter cooling the strip and coiling the strip in the incubator to maintain temperature. Thereafter the strip is passed through the hot reversing mill for its final pass prior to further treatment utilizing the cooling means and the incubator. The process may also include utilizing a second incubator to control the precipitation phenomenon.

Our method and apparatus find particular application with the hot reversing mill which in conjunction with the incubator provides a thermomechanical means for achieving a hot rolled band with a controlled microstructure. It also has particular application to steel and its alloys although other metals having similar transformation characteristics may be processed on our apparatus and by our method.

DESCRIPTION OF THE PREFERRED EMBODIMENTS

Figure 1:
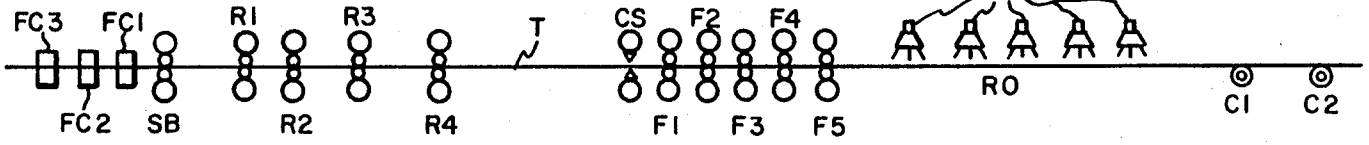
Fig. 1 (PRIOR ART)
FIG. 1 is a schematic of a standard prior art semi-continuous hot strip mill.

The standard semi-continuous hot strip mill is illustrated in FIG. 1. The slab heating is provided by means of three reheat furnaces FC1, FC2 and FC3. Immediately adjacent the reheat furnaces is a scale breaker SB and downstream of the scale breaker SB is the roughing train made up of four roughing mills R1, R2, R3 and R4. The slab which has now been reduced to a transfer bar proceeds down a motor-driven roll table T through a flying crop shear CS where the ends of the transfer bar are cropped. The finishing train in the illustrated example comprises five finishing sstands F1, F2, F3, F4 and F5 where the transfer bar is reduced continuously into the desired strip thickness. The finishing train is run in synchronization by a speed cone which controls all five finishing stands.

The strip exits F5 at a desired finishing temperature normally on the order of 1550° F. (843° C.) or higher with the specific finishing temperature being dependent on the type of steel. The strip then passes along the runout table RO where it is cooled by means of a plurality of water sprays WS. After being cooled to the appropriate temperature by the water sprays WS the strip is coiled on one of two downcoilers C1 and C2. It will be recognized that the schematic of FIG. 1 is just one of many types of semi-continuous hot strip mills in existence today. It will also be recognized that the water sprays on the runout table may be any of several known types which provide cooling to one or both sides of the strip.

Figure 2:
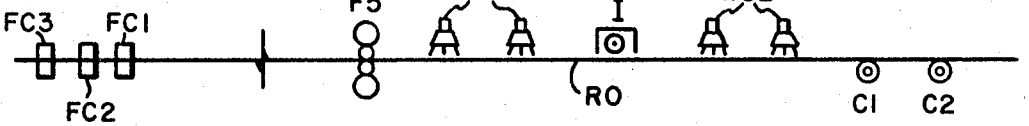
FIG. 2 is a schematic showing an incubator added to the prior art hot strip mill of FIG. 1.

The semi-continuous hot strip mill of FIG. 1 can be modified to include our incubator as shown in FIG. 2. The incubator I is positioned along the runout table RO and intermediate the water sprays so as to define a first set of water sprays WS1 upstream of the incubator and a second set of water sprays WS2 downstream of the incubator. The incubator can be located above or below the pass line. The incubator 1 must have the capability of coiling the strip from the final finishing stand and thereafter decoiling the strip in the opposite direction toward the downcoilers. A number of such coilers are known and the details of the coiler do not form a part of this invention. The incubator may also include heating means to provide external heat to the product within the incubator and may also include an atmosphere control such as a carbon dioxide enriched atmosphere to cause surface decarburization, a hydrocarbon enriched atmosphere to cause surface carburization or an inert atmosphere so as to prevent scaling or accomplish other purposes well known in the art. The details of the heat or atmosphere input into the incubator do not form a part of this invention.

Figure 3:
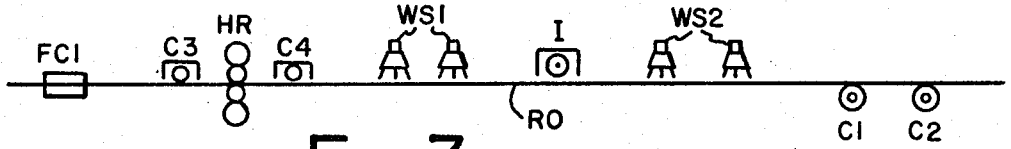
FIG. 3 is a mini-hot strip mill utilizing a hot reversing stand and an incubator.

The optimum use of an incubator is in conjunction with a mini-mill which includes or is comprised of a hot reversing stand as shown in FIG. 3. With a hot reversing mill, it is possible to have deformation, temperature reduction and delay times independent of subsequent or prior processing. This is not as easily accomplished on semi-continuous mills where a single speed cone controls the rolling of a plurality of mills. This finds particular applicability where it is desired to eliminate subsequent reheating and heat treatment and where heating and rolling are used in conjunction such as in the controlled rolling of pipeline grade steels where a heat treatment (in this case a temperature drop) is employed prior to the final deformation. The hot mill processing line includes a reheating furnace FC1 and a four-high hot reversing mill HR having a standard coiler furnace C3 upstream of the mill and a similar coiler furnace C4 downstream of the mill. Again the incubator I is positioned along the runout table RO intermediate the cooling means so as to provide a first set of water sprays WS1 upstream of the incubator I and a second set of water sprays WS2 downstream of the incubator I.

Figure 4:
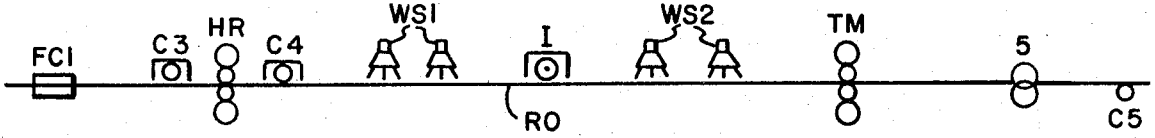
FIG. 4 is a schematic showing a modification of the mini-mill of FIG. 3 employing an in-line temper mill.
Figure 5:
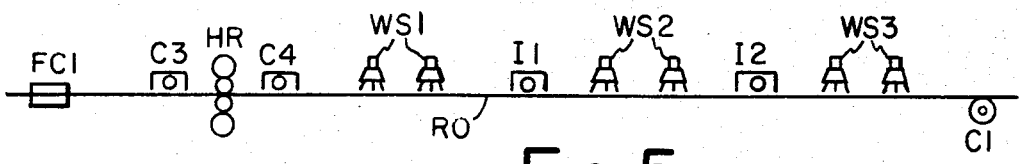
FIG. 5 is a further embodiment showing the utilization of two incubators in line with a hot reversing mill.
Figure 6:
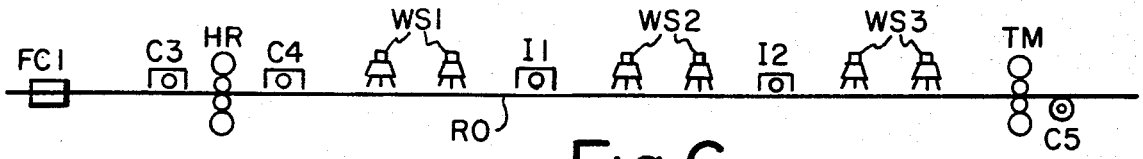
FIG. 6 is a further modification of the mini-mill of FIG. 5 including an in-line temper mill.
Figure 7:
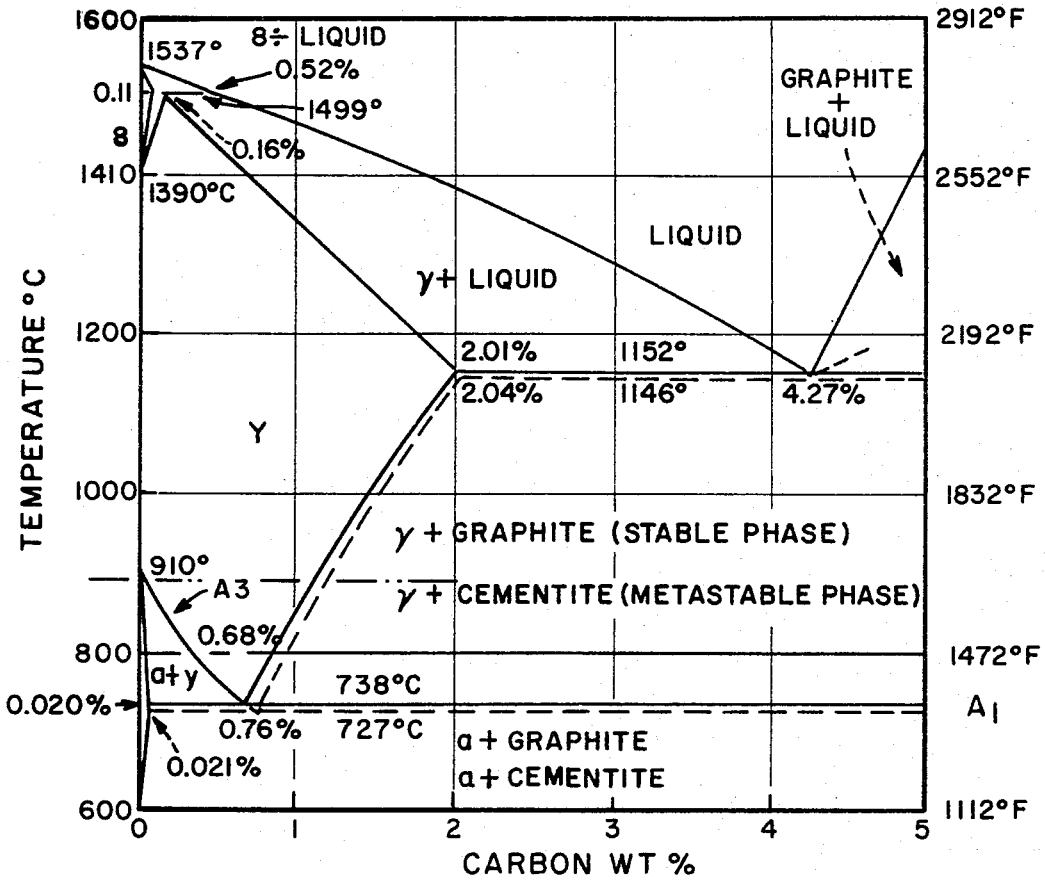
FIG. 7 is the standard iron carbon phase diagram.
Figure 8:
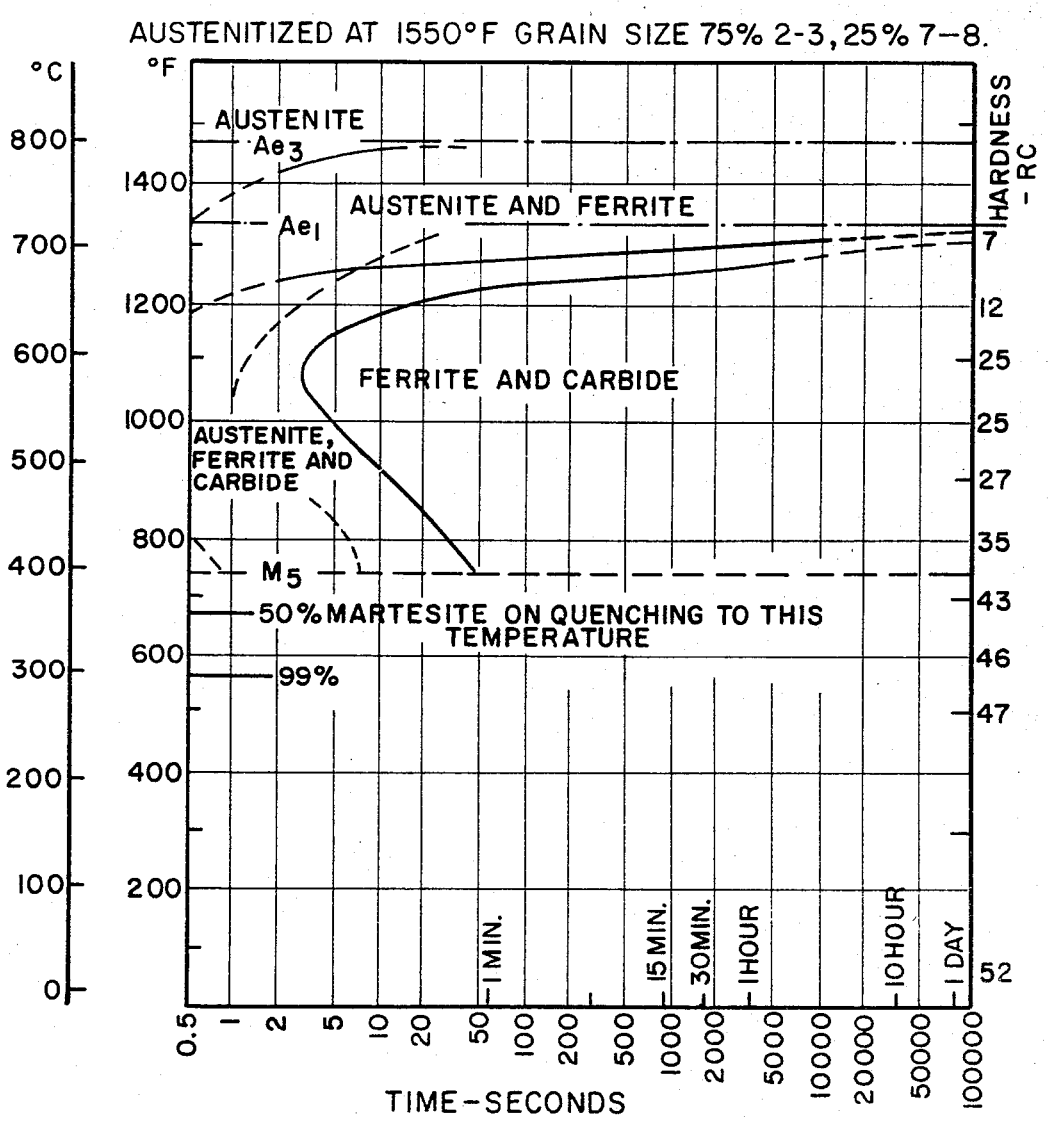
FIG. 8 is a standard TTT diagram for a low carbon steel.
Figure 9:
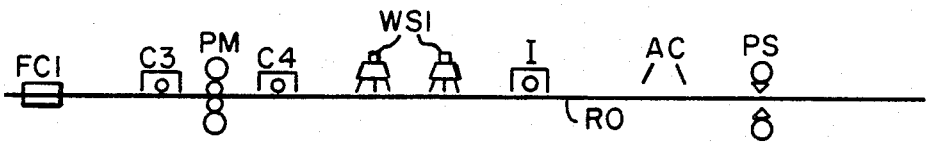
FIG. 9 is a schematic showing our invention in conjunction with a plate mill.

Since it is now possible to hold the strip in the incubator I the strip may be sufficiently cooled through the downstream cooling means WS2 so that a temper mill and/or a slitter may be included in line as part of the hot strip mill. Such an arrangement is illustrated in FIG. 4 cooled to 800° F. (427° C.) on the runout table prior to final coiling.

EXAMPLE 4

A martensitic steel can be produced by processing at a normal deformation schedule on a four-high hot reversing mill. Prior to the last pass the strip is sent onto the runout table and cooled to 50° F. (10° C.) above the $A_3$ where it is put into the incubator to equalize temperature. The final pass produces a 30% reduction sufficient to create deformation bands within the recrystallized austenite. The strip is placed into the hot reversing coil furnace for a momentary hold and thereafter it is payed out along the runout table and fast cooled to 300° F. (149° C.). It is then passed through the temper mill.

EXAMPLE 5

Dual phase steels are characterized by their lower yield strength, high work hardening rate and improved elongation over conventional steels. A typical composition would include 0.1 carbon, 0.4 silicon and 1.5 manganese. The cooling rate from the inter critical annealing temperature has been found to be an important process parameter. Loss of ductility occurs when the cooling exceeds 36° F. (2.2° C.) per second from the inter critical annealing temperature. This is believed to be due to the suppression of carbide precipitation that occurs. Using our hot strip mill the normal hot rolling sequence is followed. The strip is cooled to the desired inter critical temperature with runout cooling and thereafter it is placed in the incubator at 1380° F. (749° C.) for two minutes. Thereafter additional runout cooling is provided at 36° F. (2.2° C.) per second maximum cooling rate until the temperature reaches about 570° F. (299° C.). Alternatively this process could be optimized by putting the coil into a second incubator when the temperature on the runout table reaches 800° F. (427° C.) where it is known that carbide precipitation will occur. The function of a second incubator is to effect nearly complete removal of carbon from solution to produce a material that is soft and ductile.

EXAMPLE 6

High strength low alloy steels may be processed the same as the normalized steel of Example 3 except that a longer incubation period at 1100° F. (593° C.) is required. Times on the order of 180 seconds are required and thereafter standard cooling may be employed.

It can be seen that our invention provides an almost limitless number of processing techniques to provide a controlled microstructure for a thermomechanically rolled hot strip product. Since entire subsequent processing steps and apparatus can be eliminated, lengthened runout tables and increased cooling means are economically feasible.

We claim:

1. A method of thermomechanically rolling a steel hot strip product to a controlled microstructure on a hot strip mill including a final reducing stand and an incubator positioned along a runout table intermediate first and second cooling means comprising in sequence:

A. causing the strip to leave the final reducing stand at a temperature above the $A_3$;

B. cooling said strip below the $A_3$ by the first cooling means;

C. coiling the strip in the incubator;

D. holding the strip in the incubator between the $A_1$ and $A_3$ temperatures to cause nucleation and growth of ferrite particles in austenite;

E. decoiling the strip out of the incubator; and

F. cooling said strip out of the incubator by the second cooling means to minimize grain growth and carbide coarsening.

2. The method of claim 1, including fast cooling the strip of step F to on the order of 300° F. (149° C.) or less and temper rolling said fast cooled strip in-line.

3. A method of thermomechanically rolling a steel hot strip product to a controlled microstructure on a hot strip mill including a hot reversing mill with coilers on either side thereof as the last reducing stand and an incubator positioned along a runout table comprising in sequence:

A. reducing the product in a hot reversing mode on the reversing mill at a standard deformation schedule through the penultimate pass and substantially above the $A_3$;

B. cooling the strip on a runout table to about 50° F. (10° C.) above the $A_3$;

C. coiling the strip in the incubator to equalize temperature;

D. finally reducing the strip; and

E. cooling the strip on the runout table.

4. The method of claim 3 including cooling the strip after final deformation to approximately 1100° F. (593° C.) on the runout table, coiling the strip in the incubator and equalizing temperature by holding the strip in the incubator prior to cooling on the runout table.

5. The method of claim 3 including holding the strip after final deformation in one of the hot reversing mill coilers and fast cooling the strip on the runout table.

6. The method of claim 5 including fast cooling the strip to about 300° F. (149° C.) and temper rolling the strip in-line.

7. The method of claim 3 including finally reducing the strip through a substantial deformation and holding the strip in the incubator to promote recrystallization.

8. The method of claim 7 including rapid cooling of the strip to about 300° F. (149° C.) and temper rolling the strip in-line.

9. A method of thermomechanically rolling a steel hot strip product to a controlled acicular ferrite microstructure on a hot strip mill including a hot reversing mill with coilers on either side thereof as the last reducing stand and an incubator positioned along a runout table comprising in sequence:

A. rolling the product in the austenite range;

B. cooling the product to a temperature in the $A_1$–$A_3$ range;

C. coiling and holding the product in the incubator to equalize temperature and nucleate ferrite;

D. finish rolling with a final substantial deformation pass;

E. runout cooling to a bainite reaction temperature range;

F. coiling the product and holding it in an incubator to equalize temperature and effect bainite reaction; and G. air cooling the product.

10. A method of thermomechanically rolling a hot strip product to a controlled microstructure on a hot strip mill including a final reducing stand and an incubator positioned along a runout table intermediate first and second cooling means comprising in sequence:

A. reducing the strip on the final reducing stand to a predetermined thickness;

B. cooling said strip by the first cooling means to a given temperature;

C. coiling the strip in the incubator;

D. holding the strip in the incubator for a given time and temperature;

E. decoiling the strip out of the incubator; and

F. cooling the strip by the second cooling means.

* * * * * cooled to 800° F. (427° C.) on the runout table prior to final coiling.

EXAMPLE 4

A martensitic steel can be produced by processing at a normal deformation schedule on a four-high hot reversing mill. Prior to the last pass the strip is sent onto the runout table and cooled to 50° F. (10° C.) above the $A_3$ where it is put into the incubator to equalize temperature. The final pass produces a 30% reduction sufficient to create deformation bands within the recrystallized austenite. The strip is placed into the hot reversing coil furnace for a momentary hold and thereafter it is payed out along the runout table and fast cooled to 300° F. (149° C.). It is then passed through the temper mill.

EXAMPLE 5

Dual phase steels are characterized by their lower yield strength, high work hardening rate and improved elongation over conventional steels. A typical composition would include 0.1 carbon, 0.4 silicon and 1.5 manganese. The cooling rate from the inter critical annealing temperature has been found to be an important process parameter. Loss of ductility occurs when the cooling exceeds 36° F. (2.2° C.) per second from the inter critical annealing temperature. This is believed to be due to the suppression of carbide precipitation that occurs. Using our hot strip mill the normal hot rolling sequence is followed. The strip is cooled to the desired inter critical temperature with runout cooling and thereafter it is placed in the incubator at 1380° F. (749° C.) for two minutes. Thereafter additional runout cooling is provided at 36° F. (2.2° C.) per second maximum cooling rate until the temperature reaches about 570° F. (299° C.). Alternatively this process could be optimized by putting the coil into a second incubator when the temperature on the runout table reaches 800° F. (427° C.) where it is known that carbide precipitation will occur. The function of a second incubator is to effect nearly complete removal of carbon from solution to produce a material that is soft and ductile.

EXAMPLE 6

High strength low alloy steels may be processed the same as the normalized steel of Example 3 except that a longer incubation period at 1100° F. (593° C.) is required. Times on the order of 180 seconds are required and thereafter standard cooling may be employed.

It can be seen that our invention provides an almost limitless number of processing techniques to provide a controlled microstructure for a thermomechanically rolled hot strip product. Since entire subsequent processing steps and apparatus can be eliminated, lengthened runout tables and increased cooling means are economically feasible.

We claim:

1. A method of thermomechanically rolling a steel hot strip product to a controlled microstructure on a hot strip mill including a final reducing stand and an incubator positioned along a runout table intermediate first and second cooling means comprising in sequence:

A. causing the strip to leave the final reducing stand at a temperature above the $A_3$;

B. cooling said strip below the $A_3$ by the first cooling means;

C. coiling the strip in the incubator;

D. holding the strip in the incubator between the $A_1$ and $A_3$ temperatures to cause nucleation and growth of ferrite particles in austenite;

E. decoiling the strip out of the incubator; and

F. cooling said strip out of the incubator by the second cooling means to minimize grain growth and carbide coarsening.

2. The method of claim 1, including fast cooling the strip of step F to on the order of 300° F. (149° C.) or less and temper rolling said fast cooled strip in-line.

3. A method of thermomechanically rolling a steel hot strip product to a controlled microstructure on a hot strip mill including a hot reversing mill with coilers on either side thereof as the last reducing stand and an incubator positioned along a runout table comprising in sequence:

A. reducing the product in a hot reversing mode on the reversing mill at a standard deformation schedule through the penultimate pass and substantially above the $A_3$;

B. cooling the strip on a runout table to about 50° F. (10° C.) above the $A_3$;

C. coiling the strip in the incubator to equalize temperature;

D. finally reducing the strip; and

E. cooling the strip on the runout table.

4. The method of claim 3 including cooling the strip after final deformation to approximately 1100° F. (593° C.) on the runout table, coiling the strip in the incubator and equalizing temperature by holding the strip in the incubator prior to cooling on the runout table.

5. The method of claim 3 including holding the strip after final deformation in one of the hot reversing mill coilers and fast cooling the strip on the runout table.

6. The method of claim 5 including fast cooling the strip to about 300° F. (149° C.) and temper rolling the strip in-line.

7. The method of claim 3 including finally reducing the strip through a substantial deformation and holding the strip in the incubator to promote recrystallization.

8. The method of claim 7 including rapid cooling of the strip to about 300° F. (149° C.) and temper rolling the strip in-line.

9. A method of thermomechanically rolling a steel hot strip product to a controlled acicular ferrite microstructure on a hot strip mill including a hot reversing mill with coilers on either side thereof as the last reducing stand and an incubator positioned along a runout table comprising in sequence:

A. rolling the product in the austenite range;

B. cooling the product to a temperature in the $A_1$–$A_3$ range;

C. coiling and holding the product in the incubator to equalize temperature and nucleate ferrite;

D. finish rolling with a final substantial deformation pass;

E. runout cooling to a bainite reaction temperature range;

F. coiling the product and holding it in an incubator to equalize temperature and effect bainite reaction; and G. air cooling the product.

10. A method of thermomechanically rolling a hot strip product to a controlled microstructure on a hot strip mill including a final reducing stand and an incubator positioned along a runout table intermediate first and second cooling means comprising in sequence:

A. reducing the strip on the final reducing stand to a predetermined thickness;

B. cooling said strip by the first cooling means to a given temperature;

C. coiling the strip in the incubator;

D. holding the strip in the incubator for a given time and temperature;

E. decoiling the strip out of the incubator; and

F. cooling the strip by the second cooling means.

* * * * *